US007132021B2

(12) United States Patent
Kuroda et al.

(10) Patent No.: US 7,132,021 B2
(45) Date of Patent: Nov. 7, 2006

(54) PROCESS FOR MAKING A WORK PIECE FROM A β-TYPE TITANIUM ALLOY MATERIAL

(75) Inventors: Kouichi Kuroda, Osaka (JP); Satoshi Matsumoto, Osaka (JP); Keisuke Nagashima, Osaka (JP); Nozomu Ariyasu, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 54 days.

(21) Appl. No.: 10/860,280

(22) Filed: Jun. 4, 2004

(65) Prior Publication Data

US 2005/0000607 A1 Jan. 6, 2005

(30) Foreign Application Priority Data

Jun. 5, 2003 (JP) ..... 2003-161070

(51) Int. Cl.
*C22F 1/18* (2006.01)

(52) U.S. Cl. ..... 148/671

(58) Field of Classification Search ..... 148/670–671
See application file for complete search history.

(56) References Cited

U.S. PATENT DOCUMENTS 5,405,136 A 4/1995 Hardman
6,200,985 B1 3/2001 Cottens et al.
6,387,195 B1 5/2002 Bishop et al.
6,558,273 B1 5/2003 Kobayashi et al.
2002/0016216 A1* 2/2002 Kobayashi et al. ..... 473/324

FOREIGN PATENT DOCUMENTS

| | | | |
|---|---|---|---|
| JP | 09078213 A | | 3/1997 |
| JP | 2640415 B2 | | 5/1997 |
| JP | 2669004 B2 | | 7/1997 |
| JP | 2000-005354 | * | 1/2000 |
| JP | 2000-080458 | | 3/2000 |
| JP | 2001054595 | | 2/2001 |
| JP | 2001-214719 | | 8/2001 |
| JP | 2001231895 | | 8/2001 |
| JP | 2002-233595 | | 8/2002 |
| JP | 2002-360747 | | 12/2002 |

OTHER PUBLICATIONS

Davis et al., ASM Handbook, 1995, ASM International, vol. 4, 916-920.*

* cited by examiner

*Primary Examiner*—Roy King
*Assistant Examiner*—Michael P. Alexander
(74) *Attorney, Agent, or Firm*—Clark & Brody

(57) ABSTRACT

A process for making a work piece from a β-type titanium alloy material includes subjecting the β-type titanium alloy material to cold working with controlling the reduction rate thereof to vary the reduction rate depending on a position across a plain direction of the β-type titanium alloy material, and then subjecting the β-type titanium alloy material to an aging treatment.

4 Claims, 3 Drawing Sheets

PROCESS FOR MAKING A WORK PIECE FROM A β-TYPE TITANIUM ALLOY MATERIAL

CROSS REFERENCE TO RELATED APPLICATION

This application claims priority from Japanese Patent Application No. 2003-161070, which is incorporated herein by reference.

BACKGROUND OF THE INVENTION

1. Field of the Invention

The present invention relates to a process for making a work piece from a β-type titanium alloy material that is capable of building up the hardness distribution with the hardness continuously varied across the surface of the work piece, as intended by a designer.

2. Discussion of the Background

In recent years, a demand for lighter weight and higher stiff parts is increasing in light of energy savings and environment protections. In order to meet this demand, a demand for developing a high performance material with a hardness gradient in a certain region of the material is increasing for the purpose of designing the hardness distribution suitable for each part or member.

Particularly for a plate, if the hardness and the plate thickness can be simultaneously applied as intended by a designer, bending strength, ability of vibration restraint, performance of bend or the like can be freely imparted as designed. It is needless to say that a plate with various characteristics thus imparted can be widely used.

As a conventionally used technique to impart different characteristics to the inside of a member or part, there is a technique to apply a so-called clad material formed by combining different metals (prior art 1). For example, in order to produce a clad steel plate, two or three different metal plates are layered and hot rolled into a single plate imparted with complex characteristics. This technique has come into practice for the purpose of imparting complex characteristics including corrosion resistance characteristic, magnetic characteristic, light weight characteristic and the like, rather than building up a specific hardness distribution in a member or part.

On the other hand, varying the hardness depending on the position in the same material is achievable by a hardening treatment for increased hardness, a annealing such as a spherodite annealing for decreased hardness, or other heat treatment, in which various heat conditions are employed for each intended purpose. Particularly, induction hardening treatment allows hardening of only the surface of a material, thereby achieving improved surface wear resistance (prior art 2).

It is known that a β-type titanium alloy material is subjected to cold working and aging treatment so as to have hardness controlled for increased hardness. Japanese Patent Application Laid-open No. 2001-54595 (prior art 3) discloses that a cold working ratio is set to 15% or higher and cold working is carried out in combination with the aging treatment. According to the teaching of this prior art 3, there is provided a desirable effect in increasing the hardness of a metal plate for assuring a required material hardness and hence the durability against crack.

As described above, the prior art 1 is directed to a technique to hot rolling of two or three different metal plates layered together into a single clad steel plate, to which complex characteristics are imparted. This means that the prior reference 1 only teaches layering of different plates, which makes it possible only to arrange materials respectively having two or three hardness conditions across the surface of a plate. Accordingly, the hardness distribution with the hardness continuously or gradually changed across the surface of a plate and hence a desired hardness distribution across the surface thereof is highly unlikely to be built up by this technique. Also, there are other problems such as difficulty in assuring hardness across the bonded interface, increased manufacturing costs and the like. Therefore, this technique is applicable only to a limited area.

In building up the hardness distribution across the surface of a material by the induction hardening treatment of the prior reference 2, although regions with different hardness values are obtainable by having regions contacting and not contacting a induction coil, it is very difficult to carry out the induction hardening treatment by precisely controlling the positioning of the induction coil corresponding to each intended region and the value of the hardness to be applied to each region. Accordingly, this induction hardening treatment is not suitable for building up the hardness distribution across the surface of a material.

Although the prior reference 3 discloses subjecting the cold working and the aging treatment to a β-type titanium alloy material for improved hardness in the entire metal plate aiming at improvement in durability against crack, it neither teaches nor suggests a technique to build up the hardness distribution across the surface of a material.

It is an object of the present invention to provide a process for making a work piece from a β-type titanium alloy material with the hardness continuously or gradually changed across the surface.

SUMMARY OF THE INVENTION

According to the present invention, there is provided a process for making a work piece from a β-type titanium alloy material, including subjecting the β-type titanium alloy material to cold working with controlling the reduction rate thereof to vary the reduction rate depending on a position across a plain direction of the β-type titanium alloy material, and then subjecting the β-type titanium alloy material to an aging treatment. The β-type titanium alloy material, to which the cold working is subjected so as to have different reduction rates across the surface or have a reduction rate distribution with the reduction rate varied across the plain direction, can have a predetermined strain distribution across the plain direction. Therefore, the β-type titanium alloy material with a predetermined strain distribution, to which the aging treatment is further subjected, can have a hardness distribution with high precision as exactly intended by a designer. In a case where the cold working is carried out by press forming, it is possible to control the plate thickness distribution as well as the reduction rate distribution by changing the shape of the press die.

Throughout the description, the "surface" of a β-type titanium alloy material as meant is oriented orthogonal to the direction in which a material is pressed into a given shape by cold working. For example, in a case where a plate is pressed in the thickness direction, the "surface" of the plate is oriented orthogonal to the plate thickness direction.

In the above process, the β-type titanium alloy material may be subjected to a solution annealing prior to the cold working. The solution annealing prior to imparting a residual strain in the cold working enables a residual strain to be entirely removed in the history of working so that the β-type titanium alloy material can have a precisely controlled residual strain and therefore have the hardness distribution more precisely built up across the surface.

Moreover, in the above process, the cold working may be controlled so as to allow the β-type titanium alloy material to have a reduction rate varied across the plain direction with a minimum value of less than 10% and a maximum value of 35% or higher, and the aging treatment may be carried out at a temperature in the range of 300° C. to the β-transus temperature for 1–60 minutes. With this process, it is possible to allow the β-type titanium alloy material to have a proper reduction rate distribution for assuring a smooth surface quality required to a metal product and have a sufficient hardness for a region to be formed with high hardness.

According to another aspect of the present invention, there is provided a process for making a work piece from a β-type titanium alloy material, including subjecting the β-type titanium alloy material to cold working with controlling the reduction rate thereof to vary the reduction rate depending on a position across a plain direction of the β-type titanium alloy material, and then subjecting the β-type titanium alloy material to an aging treatment with a heating rate of 2° C./sec or higher. With this process, a desirable strain distribution is attained across the plain direction of a work piece composed of a β-type titanium alloy material, and therefore the hardness distribution can be built up with high precision according to the attained strain distribution.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Now, the description will be made for an embodiment of the present invention.

According to the present invention, a process is provided, in which a β-type titanium alloy material is subjected to cold working with various reduction rates across the surface thereof, and then aging treatment, thereby making a work piece composed of the β-type titanium alloy material with a desired hardness distribution.

A β-type titanium alloy material used in the present invention may have a varying composition. For example, it can be cited a β-type titanium alloy material having the following composition (wt. %): V 15–25, Al 2.5–5, Sn 0.5–4, O 0.12 or less, and Ti and inevitably contained impurities constitute the residue (as disclosed in Japanese Patent No. 2669004), or V 10–25, Al 2–5, Cr 2–5, Sn 2–4, O 0.25 or less, and Ti and inevitably contained impurities constitute the residue (as disclosed in Japanese Patent No. 2640415). Of these compositions, it is preferable to use the β-type titanium alloy material having the following composition (wt. %): V 15–25, Al 2.5–5, Sn 0.5–4, O 0.12 or less, and Ti and inevitably contained impurities constitute the residue, because it exhibits excellent product strength and formability.

Any cold working technique such as cold rolling and cold forging may be used as long as it can impart strain to a plate so as to attain different cold working ratio across the plain direction of a material. For example, it can be cited a technique, in which a β-type titanium alloy material to which a concave and/or convex surface profile has been applied by machining is prepared and then the surface profile of the β-type titanium alloy material is pressed into a desired shape.

An example of the present invention is presented for a more detailed description.

Figure 1:
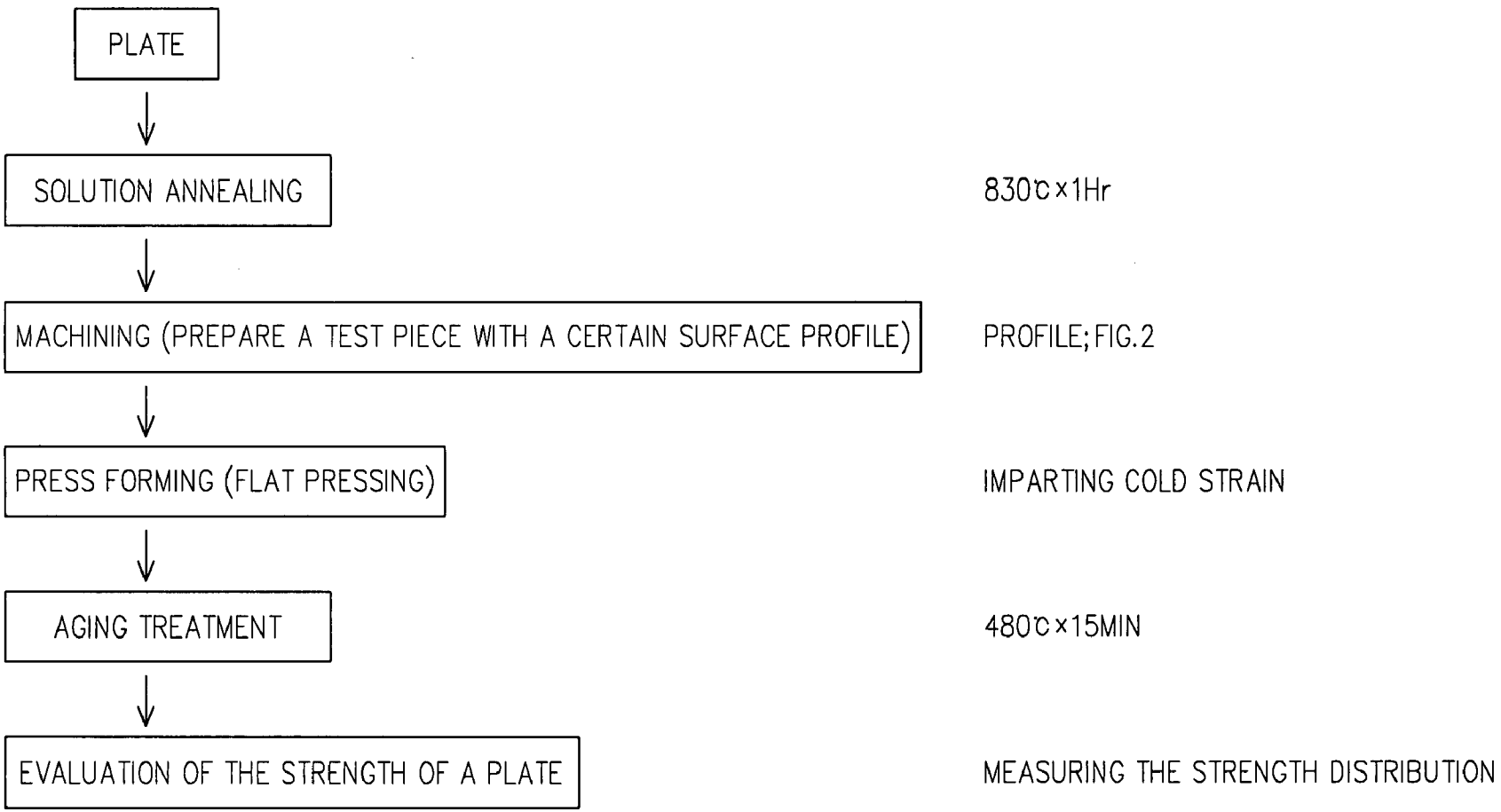
FIG. 1 is a flowchart illustrating each step of processing according to an example of the present invention.
Figure 2A:
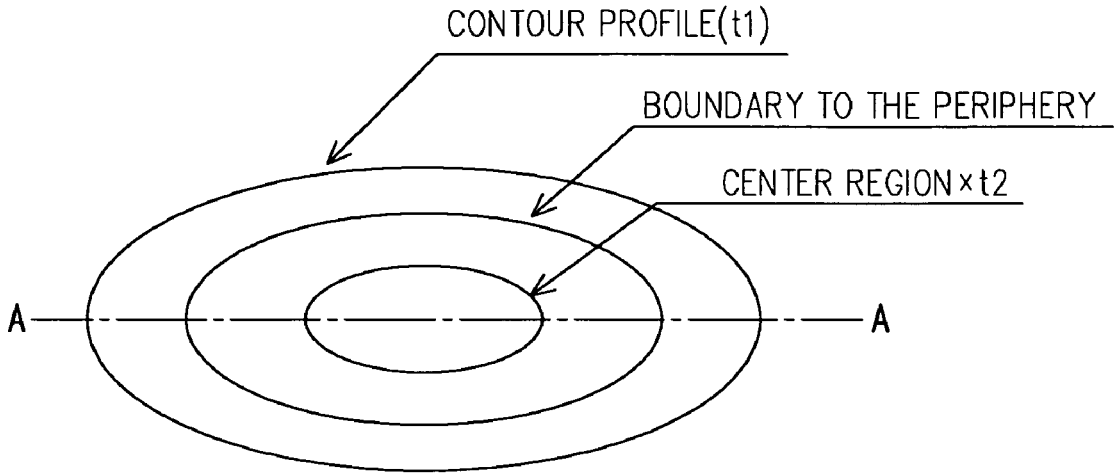
FIG. 2A is a plan view illustrating a shape of a material used in the example before pressure is applied.
Figure 2B:
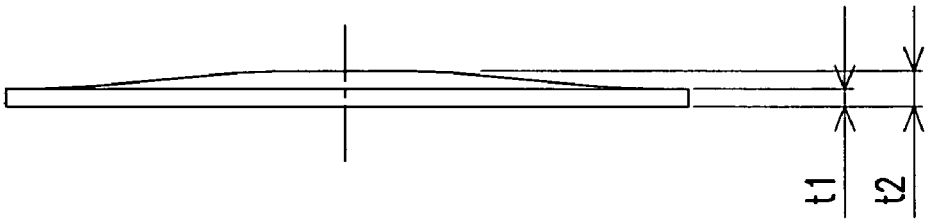
FIG. 2B is a cross section taken along lines A—A in FIG. 2A.

FIG. 1 is a flowchart illustrating each step of testing process of this example. As a β-type titanium alloy, Ti-20V-4Al-1Sn alloy was used. According to the cold working technique used in this example, the alloy is subjected to machining to have a certain surface profile to prepare a β-type titanium alloy material, which is pressed into a flat shape. FIGS. 2A and 2B illustrate a test piece, that is, a β-type titanium alloy material having a shape before subjected to pressing. According to the aging treatment as used in this example, the plate is subjected to the aging treatment in a salt bath only for 15 minutes. In this aging treatment, a temperature rise period is about 20 seconds, and a cooling period is about 5 seconds in a cooling process immediately initiated at the time when the test piece is placed out of the salt bath.

Figure 3:
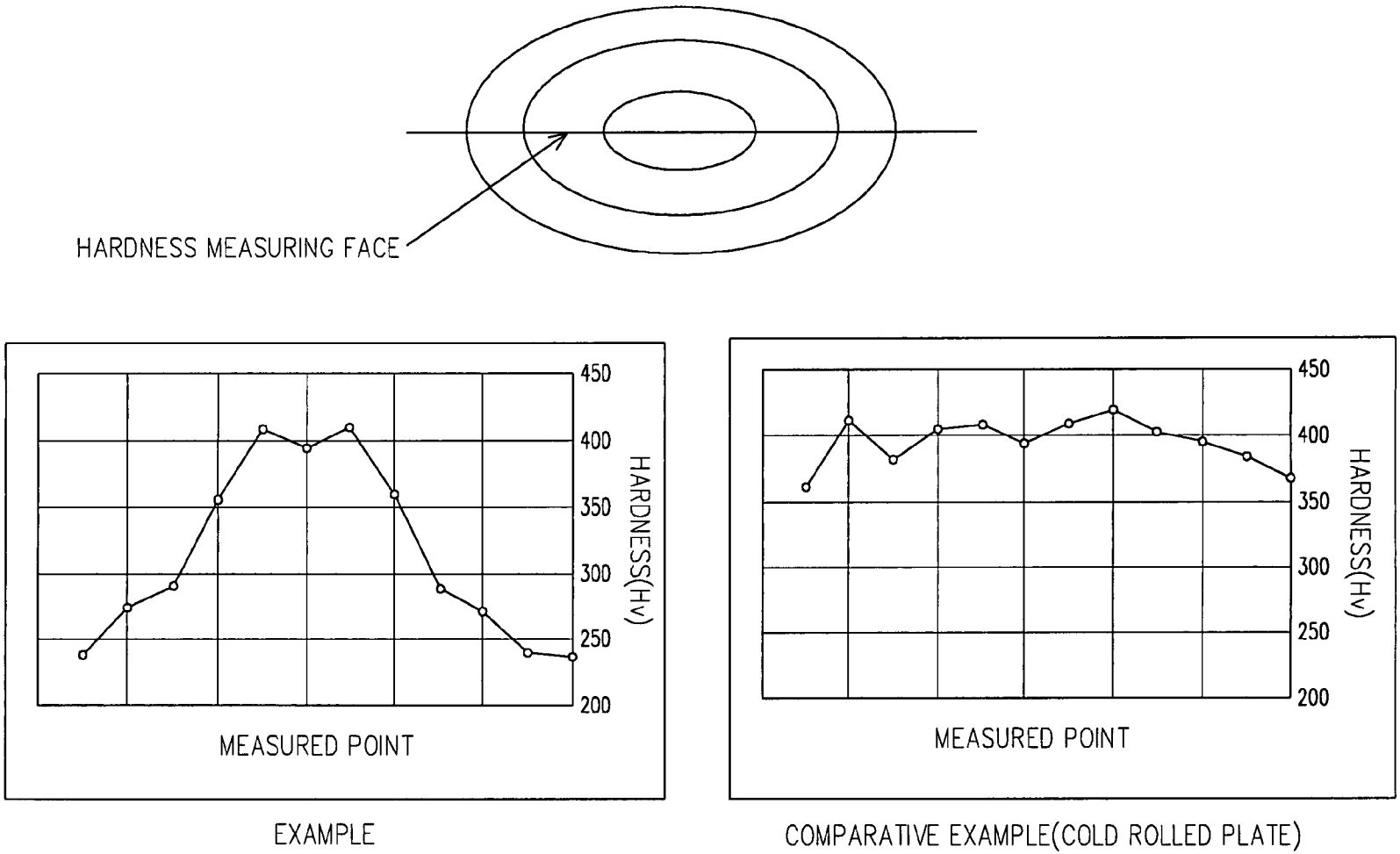
FIG. 3 is graphs illustrating hardness distribution of work pieces from a titanium alloy materials of the example of the present invention and a comparative example.

FIG. 3 illustrates the hardness distribution of a plate composed of the titanium alloy material prepared according to the process of this example. For measuring the hardness, a specimen was cut from the prepared plate, and the Vickers hardness was measured at 5 points of a specific region of the plate along the thickness from the opposite surfaces of the specimen (i.e., points respectively 0.1 mm away from the opposite surfaces, points respectively ¼ thickness away from the opposite surfaces, and the center of the thickness of the plate), and an average value calculated from them was designated as a value of the specific region.

In a comparative example, a titanium alloy having the same composition was used, in which it was subjected to cold rolling to have a substantially uniform strain across the plain direction (reduction rate: 20%).

As illustrated in FIG. 3, it is found that the plate of the comparative example after subjected to the aging treatment has a hardness substantially kept at a substantially constant value of about 360–420 (Hv) although some fluctuations are caused, while the plate of the present invention has a hardness distribution varied from 240 (Hv) to 410 (Hv).

The test results conducted under various cold working and aging treatment conditions are shown in Table 1, in which the reduction rate across the surface in the cold working was varied within a range as shown in Table 1 by varying the thickness (t1, t2) of the plate of FIG. 1.

TABLE 1

(PROCESSING CONDITIONS AND TEST RESULTS)

| | Thickness Reduction Rate | | | Hardness Distribution (Hv) | |
|---|---|---|---|---|---|
| NO. | Distribution Max. Value | Distribution Min. Value | Aging Treatment | Min. | Max. |
| 1 | 30% | 30% | 450° C. × 20 min | 380 | 390 |
| 2 | 50% | 50% | 450° C. × 20 min | 420 | 435 |
| 3 | 35% | 10% | 280° C. × 60 min | 230 | 235 |
| 4 | 35% | 6% | 350° C. × 60 min | 240 | 420 |
| 5 | 35% | 3% | 450° C. × 20 min | 235 | 385 |
| 6 | 35% | 0% | 550° C. × 3 min | 215 | 330 |
| 7 | 35% | 0% | 800° C. × 3 min | 220 | 240 |
| 8 | 60% | 5% | 450° C. × 20 min | 241 | 450 |
| 9 | 75% | 5% | 450° C. × 20 min | 235 | 465 |
| 10 | 95% | 0% | 450° C. × 20 min | — | — |

As shown in Table 1, it is possible to make a β-type titanium alloy plate having a desired hardness distribution across the surface by adjusting the reduction rate across the surface in the cold working. Particularly, when controlling the reduction rate to be varied in the range with a minimum value of less than 10% and a maximum value of 35% or higher, a β-type titanium alloy plate with a great difference in hardness across the plain direction is obtainable. However, when the maximum reduction rate in the cold working exceeds 90%, excessive strain is caused and cracking or other problem frequently occurs by the aging treatment in the next process. Therefore, the maximum reduction rate in the cold working is preferably set to 90% or lower.

With the aging treatment at a temperature below 300° C., a plate is hard to be aged even if the residual strain in the cold working exists. On the other hand, at a temperature above the β-transus temperature, a plate may be forced to be solution treated, making it hard to apply strain and then aging treatment to the plate in the subsequent heat application. Therefore, it is preferable to set the temperature of the aging treatment in the range of 300° C. to the β-transus temperature. A plate to which the aging treatment was subjected for less than one minute, is hard to be aged. On the other hand, a plate to which the aging treatment was subjected for over 60 minutes is entirely aged and therefore is hard to have a given difference in the hardness distributed across the plane. Thus, the aging treatment is preferably controlled to continue for 1–60 minutes.

Now, the description will be made for the influences due to variation of the heating rate in the aging treatment.

A plate (a plate thickness: 5 mm) composed of Ti-20V-4Al-1Sn, a β-type titanium alloy (β-transformation temperature: 740° C.) was cut into a piece having a size of 50×100 (mm). The cut piece was then subjected to the solution annealing and then varied in thickness by cutting to have the thickness varied depending on position across the surface, and then cold forged with a maximum reduction rate of about 30% and a minimum reduction rate of about 5%. Thus, a test piece was prepared.

For the aging treatment of the test piece, a salt (nitrate ) bath for rapid heating, as well as vacuum and atmospheric furnaces for gradual heating were used. The salt bath as used was made up of a heating furnace with a pot of pure titanium and a heater therearound. The temperature was measured at both the inside of the furnace and a plate. A plate as a test piece was placed into the furnace and the ongoing state of the temperature rise after placing it in the furnace was observed. The measured temperatures were automatically displayed in charts. In the heating treatment using the salt bath, the temperatures were measured in different conditions, that is, a condition with blowing air into the bottom of the pot for agitation and a condition without blowing air thereinto.

The heating rate (° C./sec) of the test piece was measured based on the following formula:

$$\text{Heating rate } (^\circ\text{ C./sec})=(T_1-10-T_0)/t$$

in which $T_1$: the set temperature of the furnace, $T_0$: the temperature of the test piece before placed into the furnace (i.e., the room temperature), and t: the time (sec.) elapsed for the test piece to reach a temperature 10° C. lower than the set temperature of the furnace. The room temperature was 20° C. The time elapsed after the test piece reached the temperature range of ±10° C. of the set temperature was designated as the aging treatment time.

In the respective heating treatments, the surface observation was taken and the Vickers hardness in the cross sectional area was measured for each test piece after the aging treatment for a give time (20 min). The Vickers hardness was measured at several points with an applied load of 49N in the high and low strain regions. The test result is shown in Table 2.

TABLE 2

Test Result

| Test Ex. | Method of Heating | Atmosphere | Set Temp. | Heating Rate of Test Piece | | Aging Time | Vickers Hardness (Hv) High strain region | Vickers Hardness (Hv) Low strain region |
|---|---|---|---|---|---|---|---|---|
| 11 | Salt bath | Nitrate (Not agitated) | 480° C. | 45 sec | 10° C./sec | 20 min | 390 | 320 |
| 12 | Salt bath | Nitrate (Agitated) | 480° C. | 15 sec | 30° C./sec | 20 min | 390 | 300 |
| 13 | Atmospheric furnace | Room air | 480° C. | 5 min | 1.5° C./sec | 20 min | 395 | 350 |
| 14 | Vacuum furnace | Vacuum | 480° C. | 1 hrs | 0.1° C./sec | 20 min | 400 | 380 |

As shown in Table 2, in a case where the salt bath is used for rapid heating with a heating rate of 2° C./sec or higher, it is possible to give a sufficient hardness difference, slowing the progress of aging in low strain regions.

On the other hand, in a case where the atmospheric or vacuum furnace is used for gradual heating with a heating rate of less than 2° C./sec, the aging is initiated when the temperature rise is in progress. This causes the progress of aging in low strain regions even after high strain regions have had an intended hardness so that the difference in hardness may be smaller than an intended difference. Accordingly, it is effective to use such as a salt bath with a heating rate of 2° C./sec or higher so as to increase the difference in hardness across the surface.

Although in this example, a salt bath was cited as an example of a heating means that achieves a heating rate of 2° C./sec or higher, any heating means such as an atmospheric furnace and vacuum furnace may be used according to the shape of a β-type titanium alloy or the set conditions of a furnace, as a heating means that achieves a heating rate of 2° C./sec or higher.

According to the present invention, by controlling the reduction rate of a β-type titanium alloy material during the cold working, the hardness distribution in the β-type titanium alloy material can be freely controlled. Also, in a case where the cold working is carried out by press forming, it is possible to control the plate thickness distribution as well as the hardness distribution by changing the shape of the press die. Accordingly, the hardness distribution and the thickness distribution as intended by the designer can be attained in a β-type titanium alloy material with high precision, thereby allowing proper design of parts or members.

This specification is by no means intended to restrict the present invention to the preferred embodiments set forth therein. Various modifications to the process for making a work piece from a β-type titanium alloy material, as described herein, may be made by those skilled in the art without departing from the spirit and scope of the present invention as defined in the appended claims.

What is claimed is:

1. A process for making a work piece from a β-type titanium alloy material, comprising subjecting a β-type titanium alloy material that has at least a portion thereof being different in thickness from a remaining portion to cold forging with controlling the reduction rate thereof to vary the reduction rate depending on a position across a plain direction of said β-type titanium alloy material by using a press die so that a given plate thickness distribution as well as a given reduction rate distribution are provided to the β-type titanium alloy material by the different thicknesses of the β-type titanium alloy material and the shape of the die, and then subjecting said β-type titanium alloy material to an aging treatment.

2. The process for making a work piece according to claim 1, wherein said β-type titanium alloy material is subjected to a solution annealing prior to said cold forging.

3. The process for making a work piece according to claim 1, wherein said cold forging is controlled so as to allow said β-type titanium alloy material to have a reduction rate varied across the plain direction with a minimum value of less than 10% and a maximum value of 35% or higher, and said aging treatment is carried out at a temperature in the range of 300 ° C. to said β-transus temperature for 1–60 minutes.

4. A process for making a work piece from a β-type titanium alloy material, comprising subjecting a β-type titanium alloy material that has at least a portion thereof being different in thickness from a remaining portion to cold forging with controlling the reduction rate thereof to vary the reduction rate depending on a position across a plain direction of said β-type titanium alloy material by using a press die so that a given plate thickness distribution as well as a given reduction rate distribution are provided to the β-type titanium alloy material by the different thicknesses of the β-type titanium alloy material and the shape of the die, and then subjecting said β-type titanium alloy material to an aging treatment with a heating rate of 2° C./sec or higher.

* * * * *